US006600507B2

(12) United States Patent
Sanchez et al.

(10) Patent No.: US 6,600,507 B2
(45) Date of Patent: Jul. 29, 2003

(54) PHOTORECEPTOR BELT TRACKING APPARATUS EMPLOYING AN ACTUATED EDGE GUIDE SYSTEM AND LOW LATERAL FORCE ROLLERS

(75) Inventors: Rene Sanchez, Berkley, CA (US); James P. Calamita, Rochester, NY (US); Daniel W. Costanza, Webster, NY (US); Michael F. Leo, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 33 days.

(21) Appl. No.: 10/034,921

(22) Filed: Oct. 22, 2001

(65) Prior Publication Data

US 2003/0076405 A1 Apr. 24, 2003

(51) Int. Cl.[7] ..... B41J 2/435; E16H 7/22
(52) U.S. Cl. ..... 347/262; 347/264; 474/122
(58) Field of Search ..... 347/116, 262, 347/264; 399/162, 165, 395, 396; 318/603; 198/750.8, 807, 810.03; 474/103, 119, 122

(56) References Cited

U.S. PATENT DOCUMENTS 3,500,694 A 3/1970 Jones et al. ..... 474/103
4,557,372 A * 12/1985 Rajagopal ..... 198/807
4,777,418 A * 10/1988 Furue ..... 318/603
4,959,040 A * 9/1990 Gardner et al. ..... 474/103
5,510,877 A 4/1996 deJong et al. ..... 399/38
5,819,140 A * 10/1998 Iseki et al. ..... 399/165
5,964,339 A * 10/1999 Matsuura et al. ..... 198/810.03
6,137,517 A 10/2000 Furst et al. ..... 347/116
6,141,526 A 10/2000 Ikeda ..... 399/395

FOREIGN PATENT DOCUMENTS

JP 4-217533 * 8/1992 ..... B65H/5/02

* cited by examiner

*Primary Examiner*—Hai Pham
(74) *Attorney, Agent, or Firm*—Perman & Green, LLP

(57) ABSTRACT

A system and method for tracking belts disposed on rollers in a photoreceptor apparatus. The system includes a movable, belt edge guide that operates in combination with an encoder, a belt edge sensor, a belt hole sensor for detecting a hole in the belt surface, wherein the profile of the edge of the belt is learned as a function of the belt position on the rollers. The encoder and belt hole sensor are used to actuate the edge guide system to compensate for the contours of the belt edge and to maintain a constant lateral position of the belt at any given point on the belt.

5 Claims, 3 Drawing Sheets

PHOTORECEPTOR BELT TRACKING APPARATUS EMPLOYING AN ACTUATED EDGE GUIDE SYSTEM AND LOW LATERAL FORCE ROLLERS

BACKGROUND OF THE INVENTION

The present invention relates to electrophotographic printing machines, and more particularly to a tracking system for laterally moving belts in electrophotographic printing machines.

Color registration in electrophotographic printing machines requires that images are precisely registered in the lateral direction. As an endless photoreceptor belt or intermediate transfer belt turns around a set of rollers similar to a continuous conveyer belt, there is typically an undesired motion of the belt that occurs back and forth in the lateral direction of the belt travel. This lateral belt motion is caused by lateral forces that are generated by misalignment of the rollers as well as belts that are conical (one belt edge longer than the other) and rolls that do not have constant diameters. Heretofore, one solution to the problem of lateral belt motion was addressed by using stationary edge guides and low lateral force rolls wherein fixed edge guides are located on either side of the belt to prevent it from walking off the rolls completely. These edge guides supply an equalizing force to that generated by the misshapened belt and misaligned rollers. However, in using stationary edge guides, the belt will still move back and forth according to the contour profile of the belt edge. When this type of belt guidance system is used in a single pass color xerographic application, the lateral belt motion due to the belt edge profile causes a misregistration of the colors.

A feature of the disclosed embodiment is an apparatus for tracking belts in an electrophotographic printing machine. That includes an actuated (i.e. movable) edge guide system that operates in combination with a belt edge sensor, a belt hole sensor and low lateral force rollers. The P/R, or IBT module is racked (making the long axis of the rollers not parallel) slightly so that the belt has a tendency to walk toward the edge guide. The profile of the belt edge is learned as a function of belt position. This is accomplished by the use of an encoder and a belt hole sensor. Once the belt edge profile is learned, the encoder, belt edge sensor and belt hole sensor are used to actuate the edge guiding system to compensate for the contours of the belt edge. The movement of the edge guide will be prescribed to mimic the belt edge profile, which will result in a constant force being applied on the belt. In this way, a constant lateral position of any given point on the belt can be maintained.

Prior Art Statement

The following Xerox Corporation U.S. patents disclose some examples of belt tracking apparatus. U.S. Pat. Nos. 3,500,694, 5,510,877, 6,137,517, 6,141,526 issue to Ikeda discloses a color printer belt meander control method.

All the references cited herein are incorporated by reference for their teachings.

BRIEF DESCRIPTION OF THE DRAWINGS

Other objects and advantages of the present embodiment will become apparent upon reading the following detailed description and upon reference to the drawings, in which.

DETAILED DESCRIPTION

Figure 1:
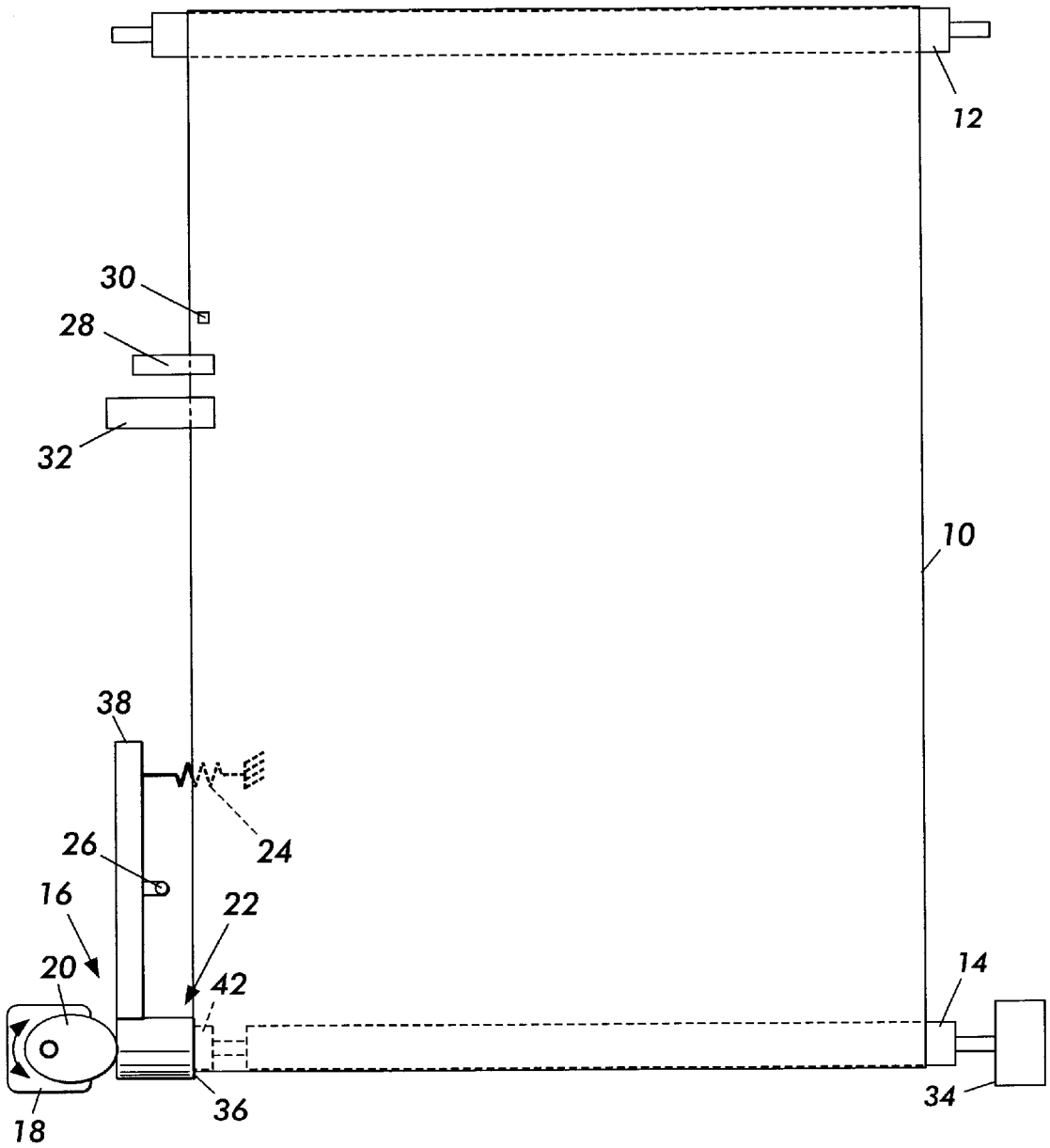
FIG. 1 illustrates a schematic elevational view of a belt tracking apparatus for an electrophotographic printing machine incorporating the features of the present invention therein.

Referring to FIG. 1, an embodiment of a belt tracking apparatus according to the present invention is illustrated wherein a photoreceptor belt module includes an endless belt 10 that is disposed on rollers 12 and 14. Rollers 12 and 14 are low, lateral force rollers. Generally, a LLF roller is similar to a standard drive roller which has an elastomer coating of a predetermined thickness that is sliced to reduce the axial stiffness between the belt wrapped on the roller and the rigid roller shaft. The elastomer material normally has a high coefficient of friction so that the belt will not slip with respect to the roller. A LLF roller limits the lateral force the edge guide must develop to prevent the belt from further lateral motion. The edge guide is driven by a movable edge guide system 16 that includes a stepping motor 18, that drives cam 20, and a moveable edge guide 22 connected to arm 38. The edge guide 22 must be placed at a roller that has a significant amount of belt wrap in order to maximize the edge force that can be generated before belt edge damage will occur. The moveable edge guide 22 is shaped such that the guide supports the edge of the belt 10. There is a raised section of the guide 22 that acts as a stop to prevent lateral motion of the belt 10 past this point. The edge guide 22 is spring loaded by spring 24 about a pivot 26 so that the natural position of the movable edge guide 22 is away from the edge of belt 10. The stepping motor 18 drives cam 20, thus pushing the movable edge guide 22 to apply force to the belt 10.

Figure 2:
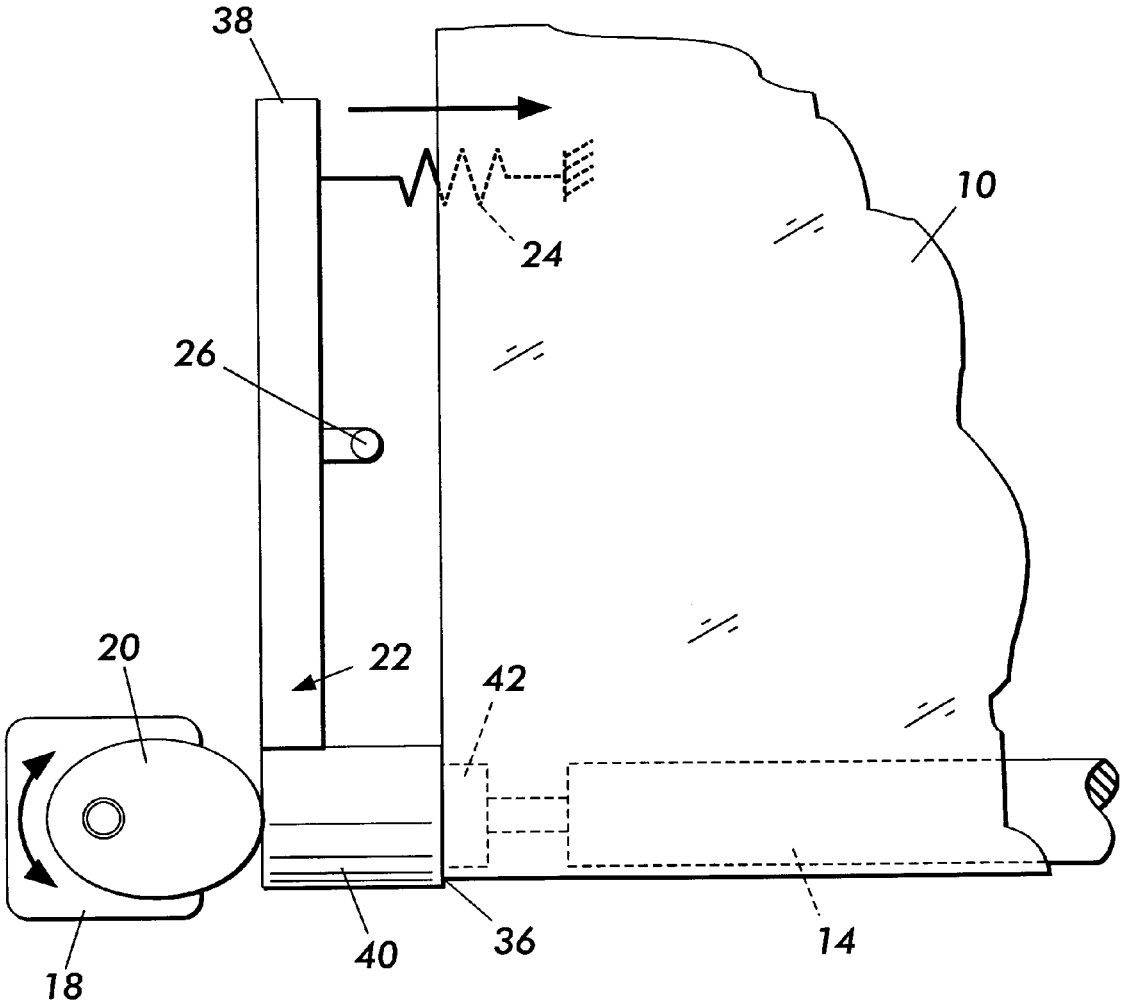
FIG. 2 is a portion of the belt tracking apparatus of FIG. 1 showing the actuator device in more detail.

There are four sensors on the apparatus. The first is a revolution sensor device that detects the presence of an indicium located on the belt. The indicium is shown as a hole 30 in the belt in the present embodiment, but may also be magnetic or optically detected indicia and the like. In FIG. 1, a belt hole sensor 28 is shown which detects the passing of a single belt hole 30 that is located in the outer edge of the belt. This allows the number and time of each belt revolution to be monitored. The second is a belt edge sensor 32, which detects lateral motion of the edge of the belt 10. The belt edge sensor 32 is located in advance of edge guide 22. The third sensor is a rotary encoder 34 mounted on the shaft of roller 14, which senses the process motion and position of the belt 10. The fourth is a cam flag sensor that is located on the stepping motor 18 and is used to locate the cam 20 at its nominal (halfway) position. Referring to FIG. 2, the movable edge guide system 16 of FIG. 1 is shown in more detail wherein the movable edge guide 22 on arm 38 rotates around pivot point 26 as cam 20, driven by stepping motor 18, rotates and thus moves edge guide 22 laterally. An actuation head portion 40 of edge guide 22 is in contact with and applies lateral force to belt 10 at location 36 such that belt 10 also moves laterally. Spring 24 pulls on the arm 38 of edge guide 22 and keeps the actuation head portion 40 of edge guide 22 loaded against cam 20. Element 42 is a belt support for belt 10 on acuation head 40.

Figure 3:
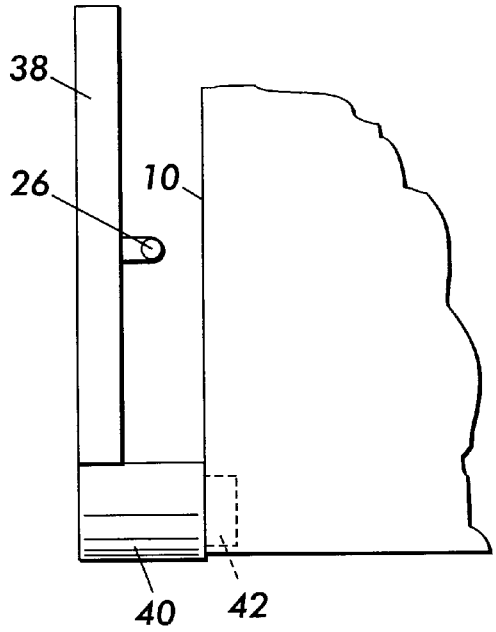
FIG. 3 is a detailed illustration of a side view of the actuation device of FIG. 1.

Referring to FIG. 3 a side view of the edge guide 22 is shown illustrating arm 38, pivot point 26, actuation head 40, belt support 42 and belt 10.

Figure 4:
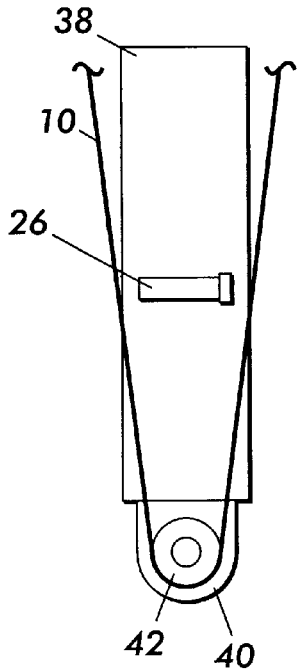
FIG. 4 is a detailed illustration of an end view of the actuation device of FIG. 1.

In FIG. 4, an end view of the edge guide of FIG. 3 is shown sharing the relationship of arm 38 pivot point 26, belt support 42 and belt 10.

The following algorithm is used by the movable edge guide system 16 to minimize the lateral motion of any point on belt 10, while also accommodating any irregularities that may exist in the belt edge profile. First, belt 10 begins to be driven on rollers 12 and 14. Cam 20 is held in its nominal position and then, over a small number of belt revolutions, is driven to move the belt towards the center of the belt module. Once the belt has been moved a few mm away from its normal operating location, the edge guide is quickly returned to the normal position. The belt is then free to slowly walk back toward the movable edge guide. While the belt is walking back toward its printing position, the belt edge learning can take place. When belt hole sensor 28 detects moving belt hole 30, the learning of the edge profile of the belt 10 begins. The belt edge sensor 32 measures the lateral position of belt 10 as a function of position for one revolution of belt 10. Rotary encoder 34 is used to sample belt 10 at equal distances. This edge position versus belt length position is stored for as many belt revolutions until the belt again comes in contact with the edge guide (this is determined by the belt edge sensor readings). The method of processing this stored belt edge information can be processed similar to that which is described in previous patents by Xerox.

Once the profile of the belt edge has been learned, tracking of belt 10 can start. The learned edge profile becomes the reference signal that the controller will follow. To insure that the feed forward technique works, movable edge guide 22 has to move the same amount of belt edge movement. This is insured by using rotary encoder 34 to sample belt 10 and sense the belt's longitudinal motion. For example, if the edge was learned every N encoder pulses, the movable edge guide system will sample every N encoder pulses, and adjust its position to compensate for the change in reference.

The next time that belt hole 30 is sensed, cam 20, and thus, moveable edge guide 22, are returned to the nominal position and the procedure repeats itself. After one complete belt revolution, the motion of edge guide 22 (laterally) mimics the belt edge profile—thus applying a constant force to the belt edge and keeping all points on the surface of the belt 10 in a constant lateral position.

This learning and tracking algorithm leads to a more robust design and a lower lateral belt motion than if the belt edge profile were ignored. The controller is set up as a function of belt position in the process direction (as measured by the rotary encoder 34). This allows it to be insensitive to different process running speeds.

It should be noted that the rollers supporting the belt must be skewed slightly with respect to the belt, so that the belt has a tendency to walk towards the moveable edge guide 22 as it travels in the process direction.

It should be understood that the foregoing description is only illustrative. Various alternatives and modifications can be devised by those skilled in the art without departing from the invention. Accordingly, the present invention is intended to embrace all such alternatives, modifications and variances which fall within the scope of the appended claims.

What is claimed is:

1. Apparatus for controlling the lateral alignment of a moving belt comprising:

an endless belt disposed on and being driven in a longitudinal process direction by first and second support rollers, the belt having a hole therein;

a movable edge guide system disposed proximate to the belt for tracking the position and laterally moving the belt, the movable edge guide system including, a movable edge guide in contact with one edge of the moving belt, a belt revolution sensor for detecting an indicium disposed on the moving belt, a belt edge sensor for detecting motion of the moving belt in a lateral direction with respect to the process direction, a rotary encoder device for periodically sampling and sensing the longitudinal motion and position of the belt, wherein the position of the belt for each revolution of the belt is determined;

and a motor driven cam located proximate to the edge of the belt for applying a constant force to the edge of the belt to maintain the belt in a constant lateral position wherein the belt edge sensor initially measures the lateral position of the edge of the belt and stores the lateral position of the belt as a belt edge profile during a set up procedure, and for every revolution of the belt after the belt edge has been learned, the movable edge guide moves laterally in accordance with the stored belt edge profile so that movement of the edge guide mimics the belt edge shape thereby applying a constant force to the belt edge to maintain the belt in a constant lateral position, wherein the movable edge guide is rotatably mounted on a pivot point, and wherein the movable edge guide system further includes a spring connected to the movable edge guide to apply a spring force to position the movable edge guide away from contact with the edge of the belt, and wherein the motor driven cam overcomes the spring force to apply lateral force to the edge of the belt.

2. The apparatus of claim 1 wherein the indicium disposed on the belt is said hole, and the belt revolution sensor is a hole sensor.

3. The apparatus of claim 1 wherein a roller or rollers in the belt assembly have been made not parallel to the others so that the belt has a tendency to walk towards the moveable edge guide.

4. A method for laterally registering a belt in an electrophotographic printing machine comprising the steps of:

A) learning the belt edge shape by measuring the lateral position of the belt;

B) storing the measured lateral position as the edge profile of the belt;

C) applying lateral force to the belt by a movable edge guide system including a movable edge guide, a motor driven cam, and a spring for applying a spring force to position the movable edge guide away from contact with the edge of the belt, and wherein the motor driven cam overcomes the spring force to apply lateral force to the edge of the belt thereby maintaining the belt in a lateral position in accordance with the belt edge profile data during second and subsequent revolutions of the belt.

5. The method of claim 4 wherein measuring the lateral position of the belt in step A includes detecting a belt hole in the moving belt to determine the one revolution of the belt.

* * * * *